United States Patent [19]

Swakon

[11] 4,096,077

[45] Jun. 20, 1978

[54] WEAR-INHIBITING COMPOSITION AND PROCESS

[75] Inventor: Edward Antone Swakon, Warrenville, Ill.

[73] Assignee: Standard Oil Company (Indiana), Chicago, Ill.

[21] Appl. No.: 720,265

[22] Filed: Sep. 3, 1976

Related U.S. Application Data

[63] Continuation-in-part of Ser. No. 527,714, Nov. 27, 1974, abandoned.

[51] Int. Cl.[2] ..... C10M 1/54; C10M 3/48; C10M 1/24; C10M 1/32

[52] U.S. Cl. ..... 252/33.6; 252/35; 252/39; 252/47.5; 252/50; 252/51.5 R; 252/51.5 A; 252/56 D

[58] Field of Search ..... 252/33.6, 35, 39, 47.5, 252/50, 51.5 A, 51.5 R, 56 D

[56] References Cited

U.S. PATENT DOCUMENTS

| | | | |
|---|---|---|---|
| 2,292,308 | 8/1942 | Watkins | 252/35 |
| 3,121,057 | 2/1964 | Gee et al. | 252/33.6 |
| 3,247,110 | 4/1966 | Gee et al. | 252/33.6 |
| 3,931,022 | 1/1976 | Chesluk et al. | 252/47.5 |

*Primary Examiner*—Delbert E. Gantz
*Assistant Examiner*—Irving Vaughn
*Attorney, Agent, or Firm*—Frank J. Sroka; Arthur G. Gilkes; William T. McClain

[57] ABSTRACT

Disclosed are compositions comprising a major proportion of a natural or synthetic lubricating oil and a minor proportion of an oil-soluble wear-inhibiting additive composition, said wear-inhibiting additive composition being added in wear-inhibiting amounts and comprising benzotriazole or $C_1$–$C_{20}$ alkyl substituted benzotriazole and a material selected from the group consisting of at least one half-acid half-ester, half-acid half-amide, and half-acid half-thioester of succinic or maleic acid or acid anhydride and an alcohol, amine, and mercaptan, respectively, a metal salt of at least one said half-ester, half-amide, or half-thioester, and mixtures thereof, wherein the alcohol and mercaptan comprise acyclic aliphatic compounds containing from 7 to 50 carbon atoms, wherein the amine comprises a straight-chain primary or secondary amine having from 7 to 50 carbon atoms and is selected from the group consisting of monoamines and polyamines having at least 2 carbon atoms separating each pair of nitrogen atoms, and wherein said metal salt comprises a Group IIA, Group IIB, tin or lead metal salt or mixtures thereof.

19 Claims, No Drawings

WEAR-INHIBITING COMPOSITION AND PROCESS

RELATED APPLICATIONS

The composition disclosed in this application is related to the composition and method disclosed in U.S. application Ser. No. 446,942, filed Feb. 28, 1974 by the same inventor. This application is a continuation-in-part of U.S. Ser. No. 527,714, filed Nov. 27, 1974 and now abandoned.

BACKGROUND OF THE INVENTION

1. Field of the Invention

This invention relates to lubricating oil compositions especially those containing oil-soluble wear inhibitors. More particularly, this invention relates to compositions containing at least one half-acid half-ester, half-acid half-amide, and half-acid half-thioester or certain acids and acid anhydrides, metal salts thereof, and mixtures thereof and benzotriazole or $C_1$–$C_{20}$ alkyl substituted benzotriazole.

2. Description of the Prior Art

Anti-wear agents are intended to decrease wear of machine parts. Wear inhibitors for incorporation in motor oils and industrial oils are finding greater use as a result of greater stress placed on moving parts in high performance engines. Numerous additives have been developed for use in such oil compositions to improve the lubricating characteristics thereof and thereby to lessen the wear of the moving parts. Thus far, additives bearing some resemblance to the additives employed in the composition and method of this invention have already been used in lubricating oils. For example, certain polycarboxylic acids and derivatives thereof have been used successfully as one-component anti-rust agents in fuel oils and lubricating oils, even though they have not been used as anti-wear agents. Stromberg, U.S. Pat. No. 3,172,853 discloses a process for inhibiting the corrosion of ferrous metals in contact with corrosive media which is characterized by treating such metals with a compound having one ester group, one amide group, and two carboxylic acid groups per molecule. The molecule is formed by the reaction of two moles of an alkenyl succinic acid or an anhydride thereof and one mole of an aminoalkanol or substituted aminoalkanol. The alkenyl radical on the succinic acid portion of the molecule has from two to 32 carbon atoms.

Widmir et al., U.S. Pat. No. 3,576,743 discloses oil-soluble compositions which neutralize corrosion-causing materials in lubricants and fuels. These oil-soluble compositions are produced by reacting one equivalent of a high molecular weight polycarboxylic acid acylating agent containing a substituent having at least about thirty aliphatic carbon atoms with at least one equivalent of a polyhydric alcohol to form an ester-containing reaction mixture, which is the effective agent of the invention. This patent points out that the esterification may not go to completion: the ester-containing reaction mixture may contain acidic esters as well as some unreacted acylating agent.

Alink, U.S. pat. No. 3,762,873 discloses a process of inhibiting corrosion of metals and alloys in oxygenated and/or aqueous media which comprises adding to the media a corrosion-inhibiting amount of a substituted succinimide or derivative thereof, formed by reacting a hydrocarbon having from five to one hundred carbon atoms with a maleic anhydride or derivative thereof to yield a hydrocarbon-substituted succinic anhydride and then reacting the succinic anhydride with an amine to form an imide.

The compounds disclosed in the above patents are illustrative of one-component anti-rust agents having an oil-solubilizing group in the acyl portion of the compound rather than in, for example, the alcohol or amine portion of the molecule. The compounds disclosed in U.S. Pat. Nos. 3,183,069; 3,192,022; 2,699,427; 2,598,213; 2,908,711; and 2,977,306 are illustrative, on the other hand, of one-component anti-rust agents having an oil-solubilizing group in, for example, the amine or alcohol portion of the molecule, rather than in the acyl portion of the molecule. Udelhofen, U.S. Pat. No. 3,183,069 discloses N-aliphatic dioamic acids as rust and/or corrosion inhibitors in normally liquid oleaginous compositions. These acids correspond to the structural formula

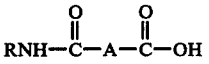

wherein R is an open-chain aliphatic hydrocarbon group containing from eight to 21 carbon atoms and A corresponds to the empirical formula $—C_2H_4O_x—$ wherein $x$ is one or two.

Gee et al., U.S. Pat. No. 3,192,022 discloses a non-lubricating, normally liquid, petroleum distillate containing a small amount, based on the weight of the distillate and sufficient to inhibit the distillate against rusting, of a succinamic acid formed by the reaction of one or two equivalents of succinic acid with one equivalent of N,N′ hydrocarbon-substituted methylene diamine wherein the hydrocarbon substituents are tertiary aliphatic hydrocarbon groups, each of which contains from about ten to about thirty carbon atoms and has a tertiary carbon atom attached directly to the nitrogen atom.

Smith et al., U.S. Pat. No. 2,699,427 discloses a rust-inhibitor for mineral oils of the fuel and lubricant type having the formula

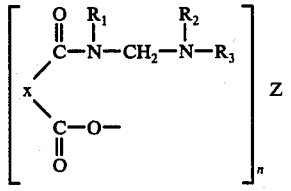

where

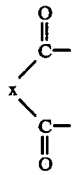

represents the acyl residue of a dicarboxylic acid capable of forming a cyclic acid anhydride; $R_1$ and $R_2$ represent radicals selected from the group consisting of acyclic aliphatic radicals having at least 8 carbon atoms, cycloalkyl, aryl, alkaryl, aralkyl; $R_3$ is selected from the group consisting of hydrogen and a radical of the same kind as $R_1$ and $R_2$; Z is selected from the group consisting of hydrogen and a salt-forming radical, and $n$ is an integer equal to the valence of Z.

Blair, U.S. Pat. No. 2,598,213 discloses a corrosion inhibitor for use in preventing corrosion of metals which are in contact with a corrosive oil-containing medium. This inhibitor must contain at least one strongly basic amino nitrogen atom and at least one non-basic amido nitrogen atom in which the acyl radical of the amido group is derived from a higher molecular weight monocarboxy acid. However, there may be present other non-basic amido radicals derived from acids having less than 6 carbon atoms.

Halter, et al., U.S. Pat. No. 2,908,711 discloses rust inhibitors for liquid hydrocarbon compositions which are the reaction products of at least the partial amidation of itaconic acid with a diamine.

Godfrey, et al., U.S. Pat. No. 2,977,306 discloses rust inhibitors which are the reaction products of the reaction between an alphabeta dicarboxylic acid containing fewer than 6 carbon atoms and a branched chain primary amine containing at least 10 carbon atoms. A partially amidated dicarboxylic acid can then be esterified with a longchain alcohol.

Thus far, no one has discovered the simple and versatile wear-inhibiting additive composition of this invention.

SUMMARY OF THE INVENTION

The composition of this invention comprises a major proportion of a natural or synthetic lubricating oil and a minor proportion of an oil-soluble wear-inhibiting additive composition, said wear-inhibiting additive composition being added in wear-inhibiting amounts and comprising benzotriazole or $C_1$–$C_{20}$ alkyl substituted benzotriazole and a material selected from the group consisting of at least one half-acid half-ester, half-acid half-amide, and half-acid half-thioester of succinic or maleic acid or acid anhydride and an alcohol, amine, and mercaptan, respectively, a metal salt of at least one said half-ester, half-amide, or half-thioester, and mixtures thereof, wherein the alcohol and mercaptan comprise acyclic aliphatic compounds containing from 7 to 50 carbon atoms, wherein the amine comprises a straight-chain primary or secondary amine having from 7 to 50 carbon atoms and is selected from the group consisting of monoamines and polyamines having at least 2 carbon atoms separating each pair of nitrogen atoms, and wherein said metal salt comprises a Group IIA, Group IIB, tin or lead metal salt or mixtures thereof.

The alcohol and mercaptan are generally acyclic aliphatic compounds containing from 7 to 50 carbon atoms. The amine is generally an acyclic aliphatic primary or secondary amine having from 7 to 50 carbon atoms and is selected from the group consisting of monoamines and polyamines having at least 2 carbon atoms separating each pair of nitrogen atoms. In a preferred embodiment, the alcohol, mercaptan, and amine comprise straight-chain compounds and contain from 8 to 24 carbon atoms. The alcohol contains generally only hydroxy substituents. More preferably, the alcohol is a mono-hydroxy alcohol, and the half-acid half-ester is a mono-acid mono-ester. Preferably, the amine is a secondary amine and contains only amino substituents. More preferably, the amine is a mono-amine, and the half-acid half-amide is a mono-acid mono-amide. Preferably, the mercaptan contains only a thio substituent. The metal of the metal salt comprises a Group IIA or Group IIB metal or tin or lead. More preferably, the metal of the metal salt is selected from the group consisting of calcium and zinc. The wear-inhibiting additive composition includes benzotriazole or a derivative thereof, especially benzotriazole or $C_1$ to $C_{20}$ alkyl substituted benzotriazole.

The benzotriazole or substituted benzotriazole is generally present at about 0.002 to about 0.25 weight percent, preferably at about 0.005 to about 0.05 weight percent.

The half-ester, half-amide, half-thioester, or metal salt thereof is present at about 0.025 to about 2.5 weight percent, preferably at about 0.05 to about 0.5 weight percent.

The ratio of benzotriazole or substituted benzotriazole to half-ester, half-amide, half-thioester, or metal salt thereof is commonly about 1:1 to 1:50, preferably about 10. In a preferred embodiment, the alcohol and mercaptan are acyclic aliphatic compounds containing from about 7 to about 50 carbon atoms. The amine is preferably an acyclic aliphatic primary or secondary amine having from about 7 to about 50 carbon atoms and is selected from the group consisting of monoamines and polyamines having at least 2 carbon atoms separating each pair of nitrogen atoms. More preferably, the polyamine has at least 3 carbon atoms separating each pair of nitrogen atoms. Additional preferred embodiments of this method comprise employing preferred embodiments of the oil-soluble wear-inhibiting compositions of this invention.

DETAILED DESCRIPTION

Benzotriazole is a well known, commercially available compound. For example, it is available from Sherwin-Williams under the name Cobratec 99. Benzotriazole can be prepared from o-phenylenediamine. A number of possible syntheses can be found in Organic Syntheses Collective Volume 3, p. 106–108, John Wiley and Sons, Inc. (1955). Alkyl substituted benzotriazole can be made by starting with an alkyl substituted benzene diamine which can be made by well known methods.

The wear-inhibiting agents of this invention can be prepared by any of the conventional methods known to those skilled in the art. A particularly convenient method for preparing the metal salts is a two-step process involving formation of the half-amide, half-thioester, or half-ester and then the formation of the metal salt. A particularly convenient method for preparing the half-acid half-ester, half-acid half-amide, or half-acid half-thioester is the reaction of a dicarboxylic acid anhydride with an alcohol, amine, or mercaptan, to form the half-ester, half-amide, or half-thioester, respectively. A modification of this process involves the replacement of the dicarboxylic acid anhydride with the corresponding dicarboxylic acid. In this regard, the dicarboxylic acids appear to be the substantial equivalent of their anhydrides in this process. However, when the acid is used, water is a reaction product and must be removed in order to shift the equilibrium of the reaction to the formation of the half-ester, half-thioester, or half-amide. Further, when the acid is used, there is greater danger of complete reaction of the carboxylic acid groups and, hence, of a decreased efficiency in the production of the desired half-ester, half-thioester, or half-amide. Additionally, more severe reaction conditions are required when the acid is used. Therefore, it is preferred to use the anhydride rather than the acid.

In general, this reaction is accomplished by reacting a dicarboxylic acid anhydride with either an alcohol, amine, or mercaptan in such amounts that production of the desired half-ester, half-amide, or half-thioester reaction product, respectively, is favored. If desired, the reaction may be carried out in a diluent such as mineral oil. The anhydride and either the alcohol, amine or mercaptan react at about room temperature. However, the reaction proceeds so slowly at room temperature that it is desirable to apply heat in order to produce the desired product within a reasonable time. Consequently, the mixture is heated slowly to a temperature in the range of from about 50° C. to about 150° C. Ideally, no di-ester, di-amide, or di-thioester would be formed, and thus no water would be formed as a reaction product. If a dicarboxylic acid is used as a reactant, a temperature in the range of from about 70° C. to about 150° C., preferably a catalyst such as toluene-sulfonic acid, and also preferably an azeotroping agent to remove water produced in the reaction are used.

Examples of suitable alcohols are alcohols either from natural sources or from synthetic sources such as the Alfol alcohols which are manufactured by polymerizing ethylene in the presence of aluminum alkyls and subsequent hydrolysis. For example, octyl alcohol, Alfol-8; decyl alcohol, Alfol-10; dodecyl alcohol, Alfol-12; hexadecyl alcohol, Alfol-16; octadecyl alcohol, Alfol-18; cyclohexanol, 2-octanol, dl-methol, n-hexyl alcohol, 2-ethyl-1-hexanol, 4-methylcyclohexanemethanol, 5-norbornene-2-methanol, 9-octadecen-1-ol, 2-phenoxyethanol, 2-iso-propylaminoethanol are suitable. Also suitable are straight-chain, primary fatty alcohols such as those manufactured by Proctor & Gamble Company under such trade designations as CO-1214S for a mixture of alcohols in which dodecyl alcohol predominates, CO-1695 for predominantly $C_{16}$ alcohol, and CO-1897 for predominantly $C_{18}$ alcohol. Other useful alcohols are nonyl phenoxy polyethoxy ethanols such as those manufactured under such trade names as Triton N-57, Triton N-101 and Triton N-128; nonylphenol; dodecylphenol; phenol, and p-tert-butylphenol; and alcohols manufactured by GAF such as octylphenoxypoly(ethyleneoxy)ethanols marketed under such trade names as Igepal CA-210, Igepal CA-520, dodecylphenoxypoly(ethyleneoxy)ethanols marketed under such trade names as Igepal RC-520 and Igepal RC-630, tridecyloxypoly(ethyleneoxy)ethanols marketed under such trade names as Emulphogene BC-420 and Emulphogene BC-610.

Examples of suitable mercaptans include mercaptans which correspond to the suitable alcohols described hereinabove. Additionally, suitable mercaptans include phenyl mercaptan, p-chlorophenyl mercaptan, t-decyl mercaptan, heptyl mercaptan, 1- and 2-naphthyl mercaptan, t-octyl mercaptan, tridecyl mercaptan and benzyl mercaptan.

Examples of suitable amines are $C_6$ to $C_{50}$ alkylamines. Examples of suitable primary amines are n-dodecylamine, cyclohexylamine, dehydroabietylamine, hexadecylamine, n-heptylamine, 2-ethylhexylamine, octadecylamine, and tetradecylamine. Examples of suitable secondary amines are di-2-ethylhexylamine, dibutylamine, bis(1-methylheptyl)amine, dicyclohexylamine, didodecylamine, diheptylamine, dihexylamine, dioctylamine, dipentylamine, di-isopentylamine, dipropylamine, N-methylbutylamine, N-methyloctadecylamine, N-methyloctylamine, N-isopropyloctylamine and N-methylbenzylamine. Also, suitable polyamines or multifunctional amines are the following: the N-alkyl 1,3-alkylene diamines are available under such names as Duomeen--for example Duomeen T, a diamine derived from tallow fatty amine and acrylonitrile and subsequently hydrogenated, producing predominantly N-octadecyl 1,3-propanediamine, and Duomeen C which is predominantly N-dodecyl 1,3-propane diamine--N-alkyl 1,2 alkylenediamines such as N-dodecyl 1,2-ethylene diamine; polyoxypropyleneamines such as those manufactured under their trade name POPDA-190 and POPDA-230; and 4-dodecyldiethylenetriamine. Aromatic amines such as p-toluidine, N-methylaniline, are also useful.

Suitable salts are those formed from Group IIA or IIB metals or from tin and lead. A particularly convenient method for forming the metal salt of the half-acid half-ester, half-acid halfamide, or half-acid half-thioester is the reaction of the half-ester, half-amide or half-thioester, produced as described above, with a basic metal compound—for example, a metal hydroxide or metal oxide—in a neutralization reaction. When a metal hydroxide is used, water is a reaction product and must be removed in order to shift the equilibrium of the reaction to the formation of the salt. The salt-forming reaction between the half-ester, half-amide, or half-thioester and a metal hydroxide is exothermic and proceeds spontaneously at room temperature. However, it is desirable to heat the reaction medium to a temperature in the range of from about 40° C. to about 150° C. in order to produce the desired product within a shorter time and to drive off the water formed in the reaction. An azeotroping agent for the water, such as toluene, is preferably added to assist the removal of water. Finally, any remaining toluene is stripped from the desired additive composition.

Alternately, the salt of one metal, for example a Group IA metal, and either the half-acid half-ester, half-acid half-amide, or half-acid half-thioester can be reacted with a salt or base of a Group IIA or IIB metal or of tin or lead, to form the desired metal salt.

It has been found that the addition of small amounts of benzotriazole or a derivative thereof to the half-ester, half-amide, half-thioester, or metal salt thereof improves the solubility of the half-ester, half-amide, half-thioester or metal salt thereof and often results in improved wear-inhibiting properties.

The various additive compositions of this invention do not possess exactly identical effectiveness, and the most advantageous concentrations for each such additive composition will depend to some extent on the particular additive composition used. Also, the minimum effective inhibitor concentration may vary somewhat depending on the specific nature of the oil and the other additives present.

The lubricating oils which the compositions of this invention are useful as additives and which comprise a major proportion of the lubricating oil compositions may be of synthetic, animal, vegetable, or mineral origin. Ordinarily mineral lubricating oils are preferred by reason of their availability, general excellence, and low cost. For certain applications, oils belonging to one of the other three groups may be preferred. For instance, synthetic polyester oils such as didodecyl adipate and di-2-ethylhexyl sebacate are often preferred as jet engine lubricants. Normally the lubricating oils preferred will be fluid oils, ranging in viscosity from about 40 Saybolt Universal seconds at 100° F. to about 200 Saybolt Universal seconds at 210° F. This invention contemplates also the presence of other additives in lubricating compositions. Such additives include, for example, viscosity index improving agents, pour point depressing agents, anti-foam agents, extreme pressure agents, rust-inhibiting agents, and oxidation and corrosion inhibiting agents.

The following examples are presented by way of illustration, and the invention should not be construed as limited thereto. Unless otherwise specified, alkyl groups in compounds used in these Examples are straight-chain.

EXAMPLE 1

An additive composition containing calcium dodecyl maleate was produced by first charging 210 grams (1.13 moles) of dodecyl alcohol, 100 grams (1.02 moles) of maleic anhydride and 200 grams of toluene to a 2-liter 3-neck flask equipped with a stirrer, thermometer, and Dean and Stark trap. This mixture was heated to 120° C. and refluxed at 120° C. for approximately 1 hour. Then the resulting reaction product, the half-acid of dodecyl maleate, was allowed to cool to 55° C., at which point 40 grams (0.54 mole) of calcium hydroxide was added to the reaction products. The temperature rose to approximately 85° C. The mixture was then heated to reflux, and an azeotropic mixture of toluene and water containing 19 milliliters (1.06 mole) of water distilled over. The resulting product, calcium dodecyl maleate, was a clear yellow liquid. Next, the product was cooled, and 150 grams of a solvent-extracted, dewaxed, paraffinic mineral oil having a viscosity of 840 SSU at 100° F. was added to dilute the product. Finally, the remaining toluene was stripped from the solution by heating under house vacuum.

EXAMPLE 2

A second additive composition containing calcium dodecyl maleate was prepared by first charging 105 grams (0.56 mole) of dodecyl alcohol, 50 grams (0.51 mole) of maleic anhydride, 100 grams of toluene, and 1 gram of 2,6-di-tert-butyl-p-cresol, which served as an anti-oxidant, to a 1-liter 3-neck flask similarly equipped as the flask used in Example 1. This mixture was heated to 120° C. and refluxed at about 120° C. for about 2 hours. The resulting half-acid of dodecyl maleate was then allowed to cool to 60° C., and 20 grams (0.27 mole) of calcium hydroxide was added to the reaction products. The temperature rose to 85° C., and the product became viscous. The mixture was then heated to reflux, and an azeotropic mixture of water and toluene containing about 8.5 milliliters (0.47 mole) of water distilled over. Next, the product, calcium dodecyl maleate, was cooled to 100° C., and 150 grams of the same paraffinic mineral oil used in Example 1 was added to dilute the product. Finally, the remaining toluene was stripped from the solution at 140° C. and under house vacuum. The resulting solution was filtered while hot and was transparent and colorless.

EXAMPLE 3

A third additive composition containing calcium dodecyl maleate was prepared using the same equipment as in Example 2. One hundred and five grams (0.56 mole) of dodecyl alcohol, 50 grams (0.51 mole) of maleic anhydride, 100 grams of toluene, and 15 grams (0.20 mole) of calcium hydroxide were charged to the flask. Unlike in Examples 1 and 2, less calcium hydroxide than the theoretical amount needed to completely neutralize the half-acid of dodecyl maleate was added, and this calcium hydroxide was added initially. During 1.5 hours of refluxing, an azeotropic mixture containing toluene and water distilled over. After stripping the remaining toluene, the final product was a light amber liquid. Finally, 150 grams of the oil used in Example 2 was added to dilute the product.

EXAMPLE 4

An additive composition containing calcium dodecyl succinate was prepared by first charging 205 grams (1.1 moles) of dodecyl alcohol, 100 grams (1 mole) of succinic anhydride and 100 grams of toluene to the same flask containing the same equipment as in Example 2. After refluxing this mixture at about 145° C. for 2.5 hours, the resulting product, the half-acid of dodecyl succinate, was cooled to 80° C., and 37 grams (0.5 mole) of calcium hydroxide was added to the mixture. The temperature rose to 90° C., and the solution became clear. The mixture was heated to reflux, and an azeotropic mixture of toluene and water containing 8.5 milliliters (0.47 mole) of water started to distill over at 100° C. The solution was cooled to 80° C., and 320 grams of the mineral oil used in Example 2 was added to dilute the product, calicum dodecyl succinate. The remaining toluene was stripped by heating the solution under house vacuum. Finally, the solution was filtered while still hot, and, upon cooling, it solidified to a white wax.

EXAMPLE 5

A second additive composition containing calcium dodecyl succinate was produced using the same equipment and similar conditions as in Example 4. One hundred and five grams (0.56 mole) of dodecyl alcohol, 50 grams (0.5 mole) of succinic anhydride, and 100 grams of toluene were originally charged to the flask, and 20 grams (0.27 mole) of calcium hydroxide was added later, to the half-acid of dodecyl succinate. The azeotropic mixture which distilled over contained 13.5 milliliters (0.76 mole) of water. After cooling, 150 grams of the oil added in Example 1 was added to dilute the calcium dodecyl succinate, and then the remaining toluene was stripped from the solution at 130° C. and under house vacuum. The additive composition, which was viscous and light yellow, was filtered.

EXAMPLE 6

A third additive composition containing calcium dodecyl succinate was produced using the same equipment, components, and amounts and similar conditions as in Example 5 except that benzene was used instead of toluene, the mixture initially charged to the flask was refluxed at 99° C. for 2 hours, and 225 grams of the oil was used instead of 150 grams. The final composition was a clear yellow, viscous liquid.

EXAMPLE 7

A fourth additive composition containing calcium dodecyl succinate was produced using the same equipment, components, and amounts used in Example 5 except that the oil was charged initially to the flask instead of later in the procedure. After refluxing the starting mixture at about 140° C. for between 2 and 3 hours, the resulting product, half-acid dodecyl succinate, was cooled to 80° C., and the calcium hydroxide was added. The temperature rose to 96° C. Upon refluxing, an azeotropic mixture of toluene and water containing 9 milliliters (0.5 mole) of water distilled over. When the remaining toluene was stripped, a viscous, colorless transparent liquid solution was left.

EXAMPLE 8

A fifth additive composition containing calcium dodecyl succinate was prepared using the same equipment, components and amounts used in Example 5, except that, unlike Examples 4–7, less calcium hyroxide than the theoretical amount needed to completely neutralize the half-acid of dodecyl succinate was used. After refluxing at 100°–130° C. for approximately 2 hours, the product, the half-acid of dodecyl succinate, was cooled to 40° C. Then, 15 grams (0.20 mole) of calcium hydroxide was added to the product mixture, and the temperature rose to 58° C. In this Example, some water was added with the calcium hydroxide in order to initiate the neutralization. Upon refluxing, an azeotropic mixture of toluene and water containing 9 milliliters (0.50 mole) of water distilled over. Finally, 150 grams of the oil used in Example 2 was added to dilute the product. The remaining toluene was stripped from the solution upon heating under house vacuum. The final product was a yellow liquid.

EXAMPLE 9

An additive composition containing hexadecyl succinate was produced by first charging 135 grams (0.56 mole) of hexadecyl alcohol, 50 grams (0.5 mole) of succinic anhydride and 100 grams of benzene to the same flask containing the same equipment as used in Example 2. This mixture was refluxed at 96°–99° C. for 1 hour. After cooling the resulting product, half-acid hexadecyl succinate, to 65° C., 20 grams (0.27 mole) of calcium hydroxide was added to this mixture. Then 225 grams of the oil used in Example 2 was added to dilute the resulting product, calcium hexadecyl succinate, and heating was resumed. Upon refluxing, an azeotropic mixture of benzene and water containing 11.5 milliliters (0.64 mole) of water distilled over. After stripping the remaining benzene, the resulting additive composition was a viscous liquid.

EXAMPLE 10

An additive composition containing zinc dodecyl maleate was produced in the same manner and using the same equipment, components, amounts, and conditions as in Example 1, except at 45 grams (0.55 mole) of zinc oxide was added instead of the calcium hydroxide, and then the temperature rose to approximately 65° C. Also, about 12.5 milliliters (0.69 mole) of water distilled over during refluxing instead of the approximately 19 milliliters (1.06 mole) of water in Example 1.

EXAMPLE 11

An additive composition containing a mixed calcium salt of hexadecyl maleate and dodecyl maleate was prepared by first charging 50 grams (0.27 mole) of dodecyl alcohol, 70 grams (.29 mole) of hexadecyl alcohol and 50 grams (.51 mole) of maleic anhydride, 100 grams of toluene and 1 gram of 2,6 di-tert-butyl-4-methylphenol, which served as an antioxidant, to the same flask containing the same equipment used in Example 1. After heating this mixture for 2 hours at 100° C., the resulting product mixture, the half-acid of dodecyl maleate and the half-acid of hexadecyl maleate, was cooled to 60° C., and then 20 grams (0.27 mole) of calcium hydroxide was added to the mixture. The temperature rose to 85° C. The mixture was then refluxed at about 120° C., and an azeotropic mixture of water and toluene containing 8.5 milliliters (0.47 mole) of water distilled over. Finally, 170 grams of the mineral oil used in Example 2 was added to dilute the product, and the remaining toluene was stripped from the solution at 140° C. and under house vacuum. The resulting product was a colorless liquid.

EXAMPLE 12

An additive composition containing the mixed calcium salt of dodecyl maleate and dodecyl succinate was prepared by first charging 105 grams (0.56 mole) of dodecyl alcohol, 25 grams (0.27 mole) of maleic anhydride, 25 grams (.25 mole) of succinic anhydride, and 100 grams of toluene to the same flask containing the same equipment used in Example 2. After refluxing the resulting product mixture, the half-acid of dodecyl maleate and the half-acid of dodecyl succinate, was cooled, and 15 grams (0.20 mole) of calcium hydroxide was added to the mixture. The amount of calcium hydroxide added was less than the theoretcial amount needed to neutralize all of the half-acid of dodecyl maleate and of the half-acid of dodecyl succinate. The mixture was then refluxed, and an azeotropic mixture of toluene and water containing 9 milliliters (0.50 mole) of water distilled over. Finally, 150 grams of the oil used in Example 2 was added to dilute the product, and the remaining toluene was stripped from the solution by heating under house vacuum.

EXAMPLE 13

A second additive composition containing a mixed calcium salt of dodecyl maleate and dodecyl succinate was prepared using the same equipment, components and amounts used in Example 12 and a similar procedure as used in Example 12, with the following exceptions: the oil was initially charged to the reaction mixture, and the reaction mixture was refluxed at 148° C. for approximately 1 hour. After cooling the resulting products to 60° C., 0.5 milliliter of water was added and then 18.5 grams (0.25 mole) of calcium hydroxide was added to neutralize the products. The water was added to promote the neutralization reaction. The temperature rose to 83° C. When the product mixture was refluxed, an azeotropic mixture of toluene and water containing 9.2 milliliters (0.51 mole) of water distilled over. The remaining toluene was stripped from the solution by heating under house vacuum.

EXAMPLE 14

A third additive composition containing the mixed calcium salt of dodecyl maleate and dodecyl succinate was prepared using the same equipment used in Example 2. In addition to the same amounts of the same components initially charged to the flask in Example 12, 150 grams of oil used in Example 1 was charged initially to the flask. The reaction mixture was refluxed for approximately 1.5 hours, and 1 milliliter (0.06 mole) of water distilled over. Upon cooling the resulting product mixture to 75° C., 14 grams (0.19 mole) of calcium hydroxide was added to the product mixture. As in Example 12, less calcium hydroxide than the theoretical amount needed to completely neutralize the half-acid of dodecyl maleate and the half-acid of dodecyl succinate was added. Upon refluxing, an azeotropic mixture of toluene and water containing 7 milliliters (0.39 mole) of water distilled over. The remaining toluene was stripped from the solution upon heating under house vacuum. The product was a clear, light yellow liquid.

EXAMPLE 15

A fourth additive composition containing a mixed metal calcium salt of dodecyl maleate and dodecyl succinate was prepared using the same components, amounts, equipment, and procedure as in Example 14, except that 9.5 grams (0.13 mole) of calcium hydroxide was employed instead of 14 grams (0.19 mole). As in Examples 12 and 14, less calcium hydroxide than the theoretical amount needed to completely neutralize the half-acid of dodecyl maleate and the half-acid of dodecyl succinate was added. Upon refluxing, an azeotropic mixture of toluene and water containing 4 milliliters (0.22 mole) of water distilled over. The resulting product was a milky liquid.

EXAMPLE 16

A fifth additive composition containing a mixed calcium salt of dodecyl maleate and dodecyl succinate was prepared by charging 205 grams (1.10 mole) of dodecyl alcohol, 50 grams (0.51 mole) of maleic anhydride, 50 grams (0.50 mole) of succinic anhydride, 150 grams of toluene and 300 grams of the oil used in Example 2, to the same flask containing the same equipment used in Example 1. After refluxing this mixture for 1.5 hours, the resulting products, the half-acid of dodecyl maleate and the half-acid of dodecyl succinate, were cooled to 65° C. Then 33.3 grams (0.45 mole) of calcium hydroxide was added to the product mixture, and the temperature rose to 85° C. As in Examples 12, 14, and 15, less calcium hydroxide than the theoretical amount needed to completely neutralize the half-acid of dodecyl maleate and the half-acid of dodecyl succinate was added. Upon refluxing this mixture, an azeotropic mixture of toluene and water containing 16 milliliters (0.89 mole) of water distilled over. The remaining toluene was stripped from the solution by heating under house vacuum. The product was a clear, yellow solution.

EXAMPLE 17

A additive composition containing a mixed calcium salt of decyl maleate and decyl succinate was prepared by first charging 175 grams (1.11 mole) of decyl alcohol, 50 grams (0.51 mole) of maleic anhydride, 50 grams (0.50 mole) of succinic anhydride, 100 grams of toluene, and 275 grams of the oil used in Example 2 to the same flask containing the same equipment used in Example 1. This mixture was refluxed at about 145° C. for 1.5 hours during which time 3.5 milliliters (0.20 mole) of water distilled over. An additional 50 grams of toluene was added to cool the mixture. After cooling the resulting product mixture, the half-acid or decyl maleate and the half-acid of decyl succinate, 31 grams (0.42 mole) of calcium hydroxide was added. Less calcium hydroxide than the theoretical amount needed to completely neutralize the half-acid was added. Upon refluxing, an azeotropic mixture of toluene and water containing 16 milliliters (0.89 mole) of water distilled over. The remaining toluene was stripped from the solution by heating under house vacuum.

EXAMPLE 18

An additive composition containing a mixed calcium salt of octyl maleate and octyl succinate was prepared by first charging 145 grams (1.11 mole) of octyl alcohol, 50 grams (0.51 mole) of maleic anhydride, 50 grams (0.50 mole) of succinic anhydride, 100 grams of toluene, and 230 grams of the oil used in Example 2 to the same flask containing the same equipment as in Example 1. This reaction mixture was refluxed, and 3 milliliters (0.17 mole) of water distilled over. An additional 50 grams of toluene was added to cool the mixture. After cooling the resulting product mixture, the half-acid of octyl maleate and the half-acid of octyl succinate, 31 grams (0.42 mole) of calcium hydroxide were added. Less calcium hydroxide than the theoretical amount needed to completely neutralize the half-acid was added. Upon refluxing, an azeotropic mixture of water and toluene containing 16 milliliters (0.89 mole) of water distilled over. The remaining toluene was stripped from the solution by heating under house vacuum. The final product was a clear, light yellow liquid.

EXAMPLE 19

An additive composition containing a mixed calcium salt of 2-ethylhexyl maleate and 2-ethylhexyl succinate was prepared by first charging 145 grams (1.11 mole) of 2-ethylhexyl alcohol, 50 grams (0.51 mole) of maleic anhydride, 50 grams (0.50 mole) of succinic anhydride, 150 grams of toluene, and 230 grams of the oil used in Example 2 to the same flask containing the same equipment as in Example 1. This mixture was refluxed at about 145° C. for 1.5 hours, during which time 2.6 milliliters (0.14 mole) of water distilled over. After cooling the resulting product mixture, 31 grams (0.42 mole) of calcium hydroxide was added. Upon refluxing, an azeotropic mixture of toluene and water containing 16 milliliters (0.89 mole) of water distilled over. The remaining toluene was stripped from the final solution by heating under a house vacuum. The final product was a clear, light yellow liquid.

EXAMPLE 20

A mixture of the half-acid half-ester of dodecyl alcohol and maleic anhydride and of the half-acid half-ester of dodecyl alcohol and succinic anhydride was prepared by first charging 205 grams (1.10 mole) of dodecyl alcohol, 50 grams (0.51 mole) of maleic anhydride, and 50 grams (0.50 mole) of succinic anhydride to the same flask containing the same equipment as in Example 1. This mixture was refluxed at about 150° C. for approximately 2 hours. The resulting product mixture was a clear, yellow liquid.

EXAMPLE 21

An additive composition containing the mixed calcium salt of hexyl maleate and hexyl succinate was prepared by first charging 165 grams (1.61 moles) of hexyl alcohol, 75 grams (0.77 mole) of maleic anhydride. 75 grams (0.75 mole) of succinic anhydride, 150 grams of toluene, and 300 grams of the oil used in Example 2 to the same flask containing the same equipment as in Example 1. Upon refluxing this mixture at about 150° C. for about 1.5 hours, 3 milliliters (0.17 mole) of water distilled over. After cooling the resulting product mixture, the half-acid of hexyl succinate and the half-acid of hexyl maleate, to 75° C., 55 grams (0.74 mole) of calcium hydroxide was added and the temperature of the mixture rose to 95° C. Upon refluxing at about 142° C., an azeotropic mixture of toluene and water containing 21 milliliters (1.17 moles) of water distilled over. The remaining toluene was stripped from the solution by heating under house vacuum. The final additive composition was hazy. Even a portion of this composition to which benzotriazole had been added was hazy.

EXAMPLE 22

An additive composition containing the mixed calcium salt of hexadecylmaleate and hexadecylsuccinate was prepared by first charging 265 grams (1.10 moles) of hexadecyl alcohol, 50 grams (0.51 mole) of maleic anhydride, 50 grams (0.50 mole) of succinic anhydride, 150 grams of toluene, and 350 grams of the oil used in Example 2 to the same flask containing the same equipment as in Example 1. Upon refluxing this mixture at about 155° C. for about 1 hour, 3 milliliters (0.17 mole) of water distilled over. After cooling the resulting product mixture—the half-acid of hexadecylmaleate and the half-acid of hexadecylsuccinate—to 65° C., 37 gram (0.50 mole) of calcium hydroxide was added, and the temperature of the mixture was 78° C. Upon refluxing at about 146° C., an azeotropic mixture of toluene and water containing 17.5 milliliters (0.92 mole) of water distilled over. The remaining toluene was stripped from the solution by heating under house vacuum. The final additive composition was a light yellow liquid.

EXAMPLE 23

Half-acid N-methyloctadecylsuccinamide was produced by mixing 30 grams (0.11 mole) of N-methyloctadecylamine and 10 grams (0.1 mole) of succinic anhydride in 40 grams of a solvent-extracted, dewaxed paraffinic mineral oil to make a 50 percent blend by weight of the reactants in the oil and heating the mixture at 110°-135° C. for 3.5 hours. On cooling to room temperature, the product solidifed to a white wax.

EXAMPLE 24

Half-acid N,N-di-(2-ethylhexyl) succinamide was produced by mixing 66.5 grams (0.26 mole) of di-(2-ethylhexyl) amine and 25 grams (0.25 mole) of succinic anhydride in 85 grams of a solvent-extracted, dewaxed paraffinic mineral oil, and heating the mixture slowly to 135° C.

EXAMPLE 25

Eighty-one grams (0.25 mole) of Tallow Duomeen T (an Armour product which is made up principally of N-octadecyl-1,3-diaminopropane) was mixed with 37.5 grams (0.38 mole) of succinic anhydride in 100 grams of a solvent-extracted, dewaxed paraffinic mineral oil, and the mixture was heated slowly to 175° C. to produce a mixture of mono-acid monoamides and di-acid diamides:

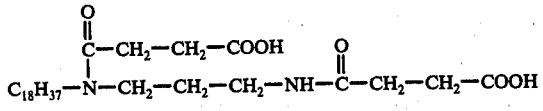

-continued

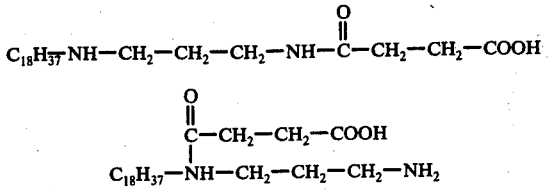

EXAMPLES 26-61

Examples 26 through 61 involve blends containing the additive compositions produced in Examples 1 through 25. Additive compositions selected from those produced in Examples 1 through 25 were tested as anti-wear agents using the Shell 4-Ball Wesr Test for wear-inhibiting characteristics of oils. Blends of these additive compositions in various master blends of oils were made. The compositions of the master blends employed in Examples 26 through 61 are presented in Table 1. The apparatus and procedure used in the Shell 4-Ball Wear Test are described in ASTM D 2266-67. The apparatus was obtained from Precision Scientific. The tests were performed under a load of 40 kilograms at 200° F. for 2 hours and at 600 revolutions per minute. Test results were reported as the diameter in millimeters of the circular scar produced in the Shell 4-Ball Wear Test. In Table 1, the components in the master blends are as follows: J—a solvent-extracted and hydrofinished, dewaxed paraffinic mineral oil having a viscosity of 380 SSU at 100° F.; K—a solvent-extracted and hydrofinished, dewaxed paraffinic mineral oil having a viscosity of 840 SSU at 100° F.; L—2,6-di-tert-butyl-4-methylphenol, an anti-oxidant; M—4,4'-tetramethyl-diamino-diphenylmethane, an anti-oxidant; N—a polyacrylate, a viscosity index improver; 0—1% silicone fluid in a light furnace oil, an anti-foam agent.

TABLE 1

| Components in Master Blends | Compositions[1] of Master Blends | | | |
|---|---|---|---|---|
| | A | B | C | D |
| J | 630 | 732 | 15890 | 730 |
| K | 1620 | 1902 | 40292 | 1900 |
| L | 6.75 | 6.9 | 150 | 6.9 |
| M | 1.65 | 1.65 | 30 | 1.65 |
| N | — | 13.5 | 300 | 13.5 |
| O | — | 1.4[2] | 30[2] | 1.5[2] |

Footnotes
[1]Expressed as the weight in grams of each component, except where indicated otherwise.
[2]Volume in milliliters

TABLE 2

| Example | Master Blend[1] | Weight of Master Blend Added[2] | Additive from Example | Weight of Additive Added[2] | Weight of Benzotriazole Added[2] | Results of Shell 4-Ball Wear Test |
|---|---|---|---|---|---|---|
| 26 | A | — | — | — | — | .68 |
| 27 | A | 375 | 1 | .375 | — | —[3] |
| 28 | A | 375 | 1 | .375 | .07 | .38 |
| 29 | A | 375 | 11 | 1.2 | — | .52 |
| 30 | A | 375 | 11 | 1.2 | .07 | .43 |
| 31 | A | 375 | 2 | 2.25 | — | .48 |
| 32 | A | 375 | 2 | 2.25 | .075 | .47 |
| 33 | A | 375 | 1 | .5 | .08 | .45 |
| 34 | A | 375 | 11 | 1.5 | .08 | .41 |
| 35 | B | 880 | 2 | 4.0 | .18 | .46 |
| 36 | A | 375 | 4 | 1.9 | — | .48 |
| 37 | A | 375 | 4 | 1.9 | .08 | .47 |
| 38 | A | 375 | 7 | 1.9 | .08 | .46 |

TABLE 2-continued

| Example | Master Blend[1] | Weight of Master Blend Added [2] | Additive from Example | Weight of Additive Added[2] | Weight of Benzotriazole Added[2] | Results of Shell 4-Ball Wear Test |
|---|---|---|---|---|---|---|
| 39 | A | 375 | 4 | 3.0 | — | .35 |
| 40 | A | 375 | 4 | 1.5 | — | .37 |
| 41 | A | 375 | 6 | 2.8 | — | .34 |
| 42 | A | 375 | 3 | 1.9 | — | .39 |
| 43 | A | 375 | 8 | 1.5 | — | .35 |
| 44 | A | 375 | 12 | 1.5 | — | .37 |
| 45 | A | 375 | 12 | 1.5 | .08 | .38 |
| 46 | A | 375 | 13 | 1.9 | .08 | .35 |
| 47 | A | 375 | 14 | 1.9 | — | .37 |
| 48 | A | 375 | 15 | 1.9 | — | .42 |
| 49 | A | 375 | 13 | 1.9 | — | .48 |
| 50 | A | 450 | 16 | 2.25 | — | .39 |
| 51 | A | 450 | 20 | 1.13 | — | .47 |
| 52 | A | 450 | 17 | 2.25 | — | .40 |
| 53 | A | 450 | 18 | 2.25 | — | .46 |
| 54 | A | 450 | 19 | 2.25 | — | .45 |
| 55 | A | 450 | 13 & 20 | 1.8 + .23 | — | .42 |
| 56 | C | 567 | 16 | 3.6 | — | .38 |
| 57 | A | 450 | 21 | 1.8 | .09 | .52 |
| 58 | A | 450 | 22 | 2.7 | — | .36 |
| 59 | A | 450 | 22 | 2.7 | .09 | .48 |
| 60 | D | — | — | — | — | .68 |
| 61 | D | 880 | 23 | 4.5 | .20 | .43 |

Footnotes
[1]The master blends corresponding to the letters are identified in Table 1.
[2]Grams.
[3]This additive composition was insoluble, and measurements could not be made.

I claim:

1. A composition comprising a major proportion of a natural or synthetic lubricating oil and a minor proportion of an oil-soluble wear-inhibiting additive composition, said wear-inhibiting additive composition being added in wear-inhibiting amounts and comprising benzotriazole or $C_1$–$C_{20}$ alkyl substituted benzotriazole and a material selected from the group consisting of at least one half-acid half-ester, half-acid half-amide, and half-acid half-thioester of succinic or maleic acid or acid anhydride and an alcohol, amine, and mercaptan, respectively, a metal salt of at least one said half-ester, half-amide, or half-thioester, and mixtures thereof, wherein the alcohol and mercaptan comprise acyclic aliphatic compounds containing from 7 to 50 carbon atoms, wherein the amine comprises a straight-chain primary or secondary amine having from 7 to 50 carbon atoms and is selected from the group consisting of monoamines and polyamines having at least 2 carbon atoms separating each pair of nitrogen atoms, and wherein said metal salt comprises a Group IIA, Group IIB, tin or lead metal salt or mixtures thereof.

2. The composition of claim 1 wherein the wear-inhibiting additive composition comprises a metal salt of at least one said half-ester or half-amide.

3. The composition of claim 1 wherein the alcohol, mercaptan, and amine contain only straight-chain aliphatic groups.

4. The composition of claim 1 wherein the alcohol, mercaptan, and amine contain from 8 to 24 carbon atoms.

5. The composition of claim 1 wherein the alcohol contains only hydroxy substituents.

6. The composition of claim 1 wherein the alcohol is a monohydroxy alcohol and the half-acid half-ester is a mono-acid mono-ester.

7. The composition of claim 1 wherein the amine is a secondary amine.

8. The composition of claim 1 wherein the amine contains only amino substituents.

9. The composition of claim 1 wherein the amine is a monoamine, and the half-acid half-amide is a mono-acid mono-amide.

10. The composition of claim 1 wherein the polyamine has at least 3 carbon atoms separating each pair of nitrogen atoms.

11. The composition of claim 1 wherein the mercaptan contains only a thio substituent.

12. The composition of claim 1 wherein the metal of the metal salt is selected from the group consisting of calcium and zinc.

13. The composition of claim 1 wherein the wear-inhibiting additive composition contains benzotriazole.

14. The composition of claim 1 wherein the benzotriazole or substituted benzotriazole is present at about 0.002 to about 0.25 weight per cent.

15. The composition of claim 14 wherein the benzotriazole or substituted benzotriazole is present at about 0.005 to about 0.05 weight per cent.

16. The composition of claim 7 wherein the half-ester, half-amide, half-thioester, or metal salt thereof is present at about 0.025 to about 2.5 weight per cent.

17. The composition of claim 16 wherein the half-ester, half-amide, half-thioester, or metal salt thereof is present at about 0.05 to about 0.5 per cent.

18. The composition of claim 1 wherein the ratio of benzotriazole or substituted benzotriazole to half-ester, half-amide, half-thioester, or metal salts thereof is about 1:1 to 1:50.

19. The composition of claim 18 wherein the ratio of benzotriazole or substituted benzotriazole to half-ester, half-amide, half-thioester, or metal salt thereof is about 1:10.

* * * * *

UNITED STATES PATENT OFFICE
CERTIFICATE OF CORRECTION

Patent No. 4,096,077 Dated June 20, 1978

Inventor(s) Edward A. Swakon

It is certified that error appears in the above-identified patent and that said Letters Patent are hereby corrected as shown below:

Column 1, line 19 "or certain" should be -- of certain --

Column 6, line 13 "halfamide" should be -- half-amide --

Column 9, line 45 "except at" should be -- except that --

Column 11, line 52 "or decyl" should be -- of decyl --

Column 12, line 52 "anhydride." should be -- anhydride, --

Column 13, line 16 "mixture was" should be -- mixture rose to --

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*